United States Patent [19]

Dale

[11] 4,428,455

[45] Jan. 31, 1984

[54] EMERGENCY DESCENT DEVICE

[76] Inventor: Armand Dale, 3100 Carling Ave., Suite 1121, Nepean, Ontario, Canada, K2B 6J6

[21] Appl. No.: 370,613

[22] Filed: Apr. 22, 1982

[30] Foreign Application Priority Data

May 6, 1981 [CA] Canada ..... 376970

[51] Int. Cl.[3] ..... A62B 1/10

[52] U.S. Cl. ..... 182/7; 182/191; 188/65.4

[58] Field of Search ..... 182/7, 5, 4, 6, 8, 9, 182/231, 235, 240, 71, 72, 10, 190–193; 188/65.1, 65.2, 65.3, 65.4, 65.5

[56] References Cited

U.S. PATENT DOCUMENTS

| | | | |
|---|---|---|---|
| 383,340 | 5/1888 | Brice | 188/65.5 |
| 512,730 | 1/1894 | Luedecke | 182/191 |
| 579,823 | 3/1897 | Forbes | 182/7 |
| 1,158,952 | 11/1915 | Amman | 188/65.5 |
| 2,448,384 | 8/1948 | Meinzinger | 188/65.1 |

FOREIGN PATENT DOCUMENTS

| | | | |
|---|---|---|---|
| 44042 | 8/1893 | Canada . | |
| 57608 | 9/1897 | Canada . | |
| 65498 | 12/1899 | Canada . | |
| 88189 | 7/1904 | Canada . | |
| 12918 | 11/1903 | Norway | 188/65.5 |

*Primary Examiner*—R. P. Machado
*Assistant Examiner*—A. Chin-Shue
*Attorney, Agent, or Firm*—Laff, Whitesel, Conte & Saret

[57] ABSTRACT

This invention relates to a fire escape for high rise buildings. Cables are automatically lowered from the roof of the building, and once they have descended, brake apparatus is slipped over each cable to be used from various levels of the building. A person is suspended from each brake apparatus, and is controllably lowered to the ground. Since the brake apparatus can be attached anywhere along the cable without prethreading, a plurality of persons can be lowered at the same time, and the same cable can be used repeatedly by many people.

18 Claims, 4 Drawing Figures

Figure 2:
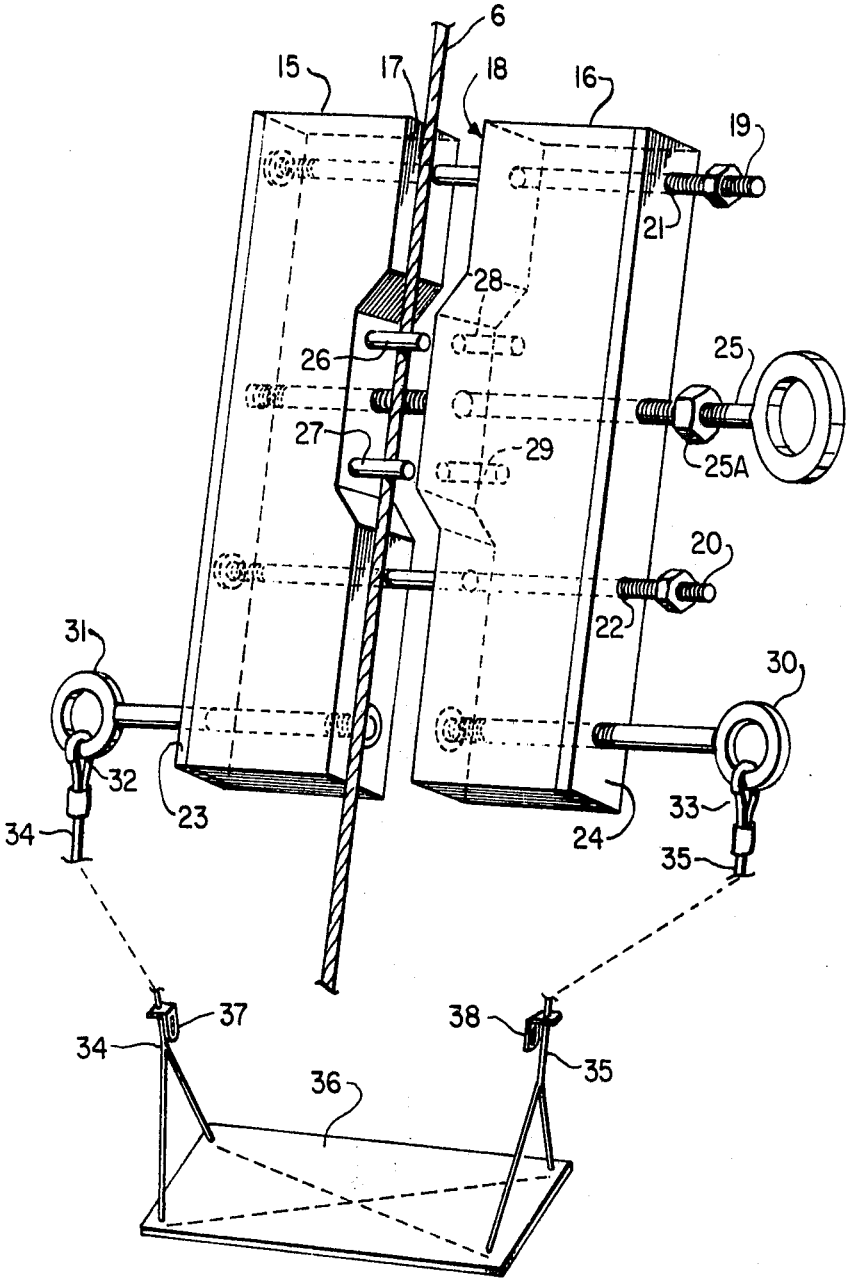

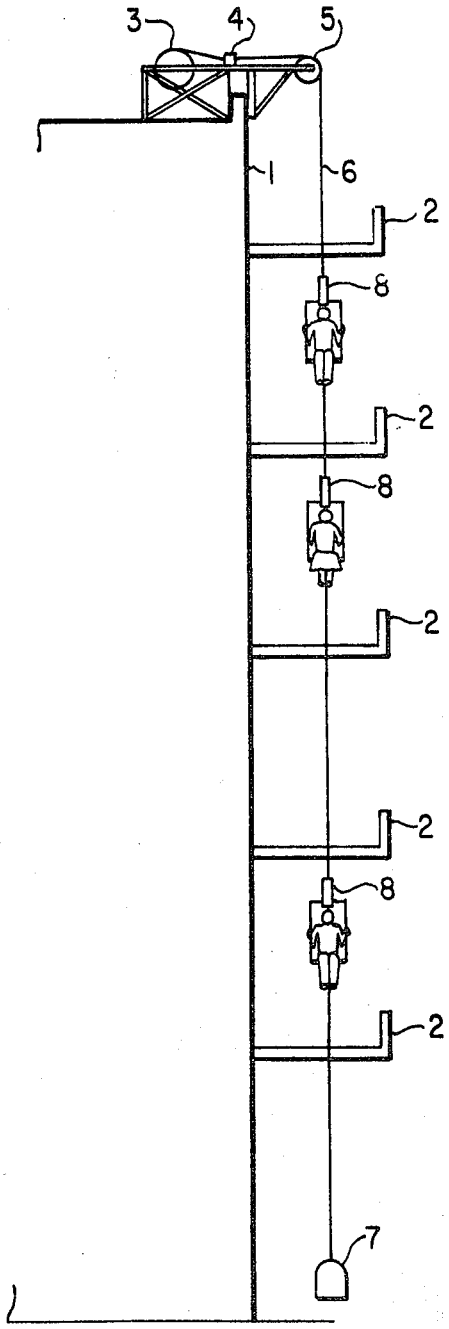
FIG. 1
FIG. 1A
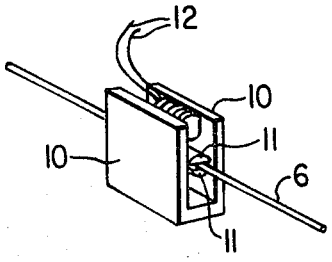

EMERGENCY DESCENT DEVICE

This invention relates to apparatus used to facilitate emergency descent by persons trapped at an elevated position in high rise buildings.

Fires in high-rise buildings pose major difficulties for persons trapped at high levels. Fire engine ladders normally can rise only a limited number of stories. Interior stairwells often not only become blocked with smoke, but provide a conduit for smoke to rise to the top of a building, thus shutting off means for persons to escape. In cases where the building has window balconies, or when persons in the building are able to find their way to the roof, helicopters are used to evacuate otherwise trapped persons. However it is often difficult to obtain sufficient numbers of helicopters to service a large building housing a large number of persons, such as a high-rise hotel. Consequently there have been many disasters in which people have been seriously hurt or killed jumping from windows many stories high, to the ground.

The present invention provides an emergency decent device which is both effective and safe. According to the present invention, cables are automatically unwound from the roof of a building past windows or balconies, to the ground, the cables being released automatically when the fire alarm rings. Within each room, or at central locations, an apparatus is made available, one to a person, which is coupled to the cable, to which apparatus a seat which can be hitched to a belt surrounding the person is connected. A plurality of persons at different floor levels along one cable all can use the cable at the same time. Once a user is on the seat, a brake control is released, allowing friction members in the apparatus to ride along the cable at a speed which is controllable by the user. As more people descend on a single cable, the descent rate of the uppermost users is slow automatically, thus compensating for a greater number of people using one cable.

The use of friction members to lower a person down a cable is not new, and indeed was invented a great many years ago. However such apparatus was not practical for a number of reasons to be described below.

In Canadian Pat. No. 65,498 to H. W. Racey, applied for on Dec. 1, 1899, a controllable descent device using a rope or cable is described. However the rope or cable must be threaded through the descent device, in a complex operation, and consequently each descent device is permanently attached to the rope or cable. The number of persons which can use a rope or cable is thus predetermined by the number of friction devices attached thereto, and in an emergency, it is virtually impossible to attach more devices to the rope or cable. Due to the complex apparatus, utilizing five wheels within a housing, regular maintenance appears to be necessary at the site at which it is attached to the rope, thus being labour intensive and costly. The apparatus itself is a complex mechanism, and thus is not inexpensive. Besides the cost, the danger of not facilitating the descent of more than a predetermined number of users due to the requirement of pre-threading, is dangerous in itself.

In Canadian Pat. No. 44,042, by Lucretia Lester, issued Aug. 24, 1893, a descent device of much simpler construction is shown. This device utilizes a pair of cooperatively shaped convoluted surfaces which clamp around a rope, friction slowing the descent of the user. In the event that the user accidentally stops squeezing the friction devices together, a camming effect results, stopping the downward descent of the user.

However the structure of the apparatus is such that as with Canadian Pat. No. 88,189, the device must be prethreaded on the rope, and additional friction devices cannot be added at the time of emergency, once the rope has dropped, with the attendant danger to persons who are left with insufficient numbers of such friction devices.

Canadian Pat. No. 57,608 to W. B. Wilson dated Sept. 28, 1897 describes a different form of emergency descent device to that of Canadian Pat. No. 44,042, and appears to be fairly inexpensive and controllable. However this apparatus suffers from the same problem as the ones described above, in that it must be threaded on the rope prior to lowering of the rope, since the rope passes through apparatus.

The present invention is a relatively inexpensive emergency descent device by which persons can be controllably lowered down a rope, but it can be attached to the rope at any position on the rope, after the rope has been lowered. Consequently any number of friction devices can be attached, limited only by the number of such devices available. Consequently a central depository of such devices can be distributed disproportionately along the building, as might be needed by congregations of persons in the building. A substantial improvement in the factor of safety afforded persons within such buildings is thus provided. Further, the devices can be distributed upon registration or entry of persons to the building, allowing their use whereby the persons might be in the event of fire.

According to the present invention, a cable is slipped sideways between a pair of friction devices, and the friction devices are moved toward each other using a brake control, preferably in the form of a screw. As the brake devices close toward each other, clamping the cable, a cable guide closes over the entrance of the cable between the friction devices, and the cable is thus held between guides on both sides of the friction devices, as they are clamped around the cable. The brake control closes the friction devices until the full weight of a person can be supported on the cable. A seat is attached to the lower portion of the apparatus, and the person sits in the seat, attaching the seat cables to his belt, or fastening a belt attached to the cables around his waist. He then swings clear of the building, supported by the cable. Release of the brake control in small degrees allows the friction members to slide over the cable, lowering the person slowly to the ground and to safety.

As more persons attach similar apparatus to the cable below, and place their weight on the cable, the upper portions of the cable tightens, thus increasing the tension of the cable against the friction members. Automatic compensation against persons suspended higher descending into persons suspended lower is thus provided.

In general, the invention is an emergency descent device comprised of a pair of friction members having cooperatively shaped adjacent convoluted surfaces, apparatus for adjusting the space between the surfaces, a first cable guide extending from one member to the other on one side thereof for retaining a cable between the convolutions of the surfaces, and a second cable guide extending from one member to the other on the other side thereof, when the surfaces are a first predetermined distance apart in which the convolutions are substantially enfolded, and extending from the one member toward, but not as far as the other when the convolutions are a second predetermined distance apart in which the convolutions are not substantially enfolded. The cable can thus be slipped between the surfaces and between the first and second cable guides when the surfaces are the second distance apart, but is retained therebetween when the surfaces are adjusted to the first distance apart.

Figure 3:
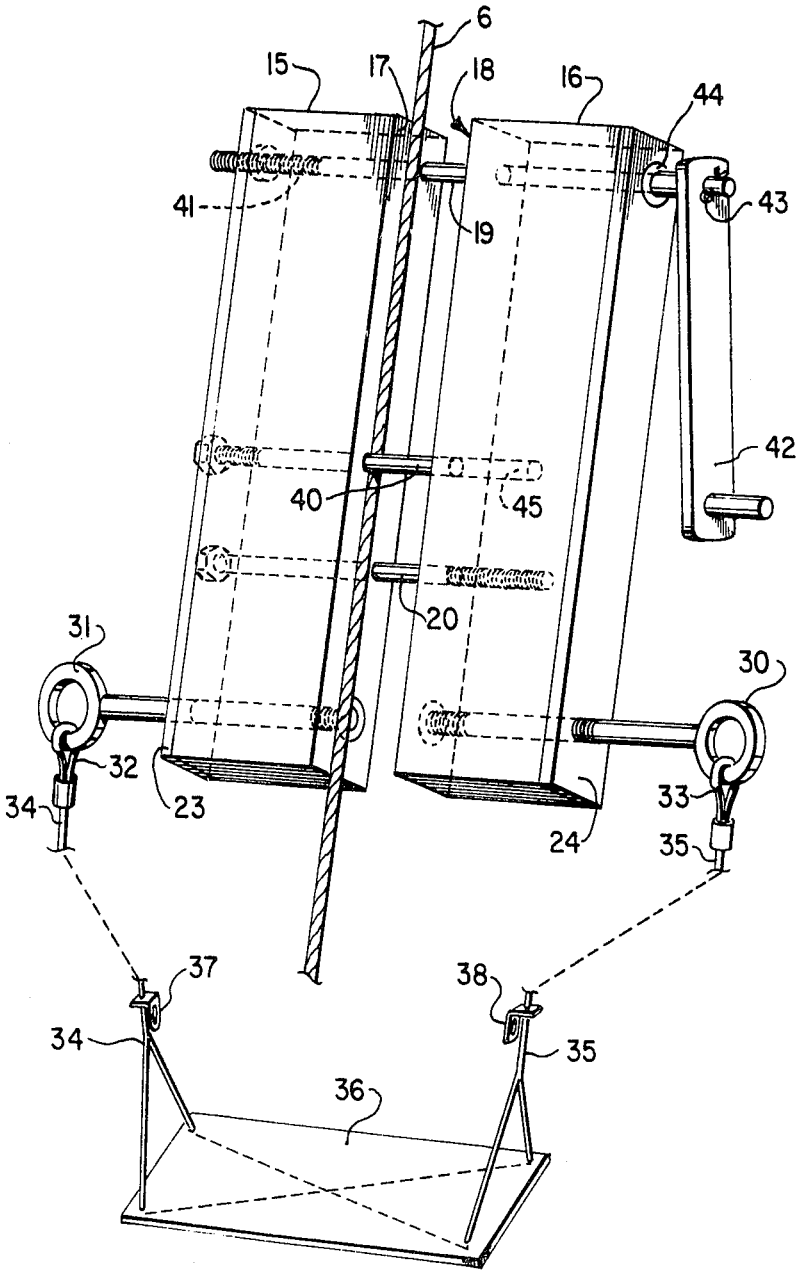

A better understanding of the invention will be obtained by reference to the detailed description below, and to the following drawings, in which:

FIG. 1 is a schematic side view of a building, with the invention in use,

FIG. 1*a* is a detail of a magnetic brake which releases the cable used in the invention, FIG. 2 is a schematic perspective, with some parts distorted in size, used to illustrate the invention, and FIG. 3 is a schematic perspective, with some parts distorted in size, used to illustrate a further embodiment of the invention.

Turning first to FIG. 1, a building 1 is shown, having a plurality of balconies 2, which illustrates generally a high-rise building. A cable reel 3, on which preferably steel cable of e.g. ¼ or ⅜th thickness cable is wound, is rotatably mounted on the roof of the building. The cable 6 passes through a magnetic brake 4, and over a rotatable reel 5, and has a weight 7 attached to its end.

When the building fire alarm operates, it releases the brake, thus allowing the weighted end of the cable 6 to pull it down from the reel to the ground. The amount of cable wound on the reel is just sufficient to reach the ground, and the reel end of the cable is fastened to the hub of the reel.

While an electric motor could have been used to unwind the reel, it is preferred to use a weight, since fire alarm systems are often connected to emergency power supplies which do not have the capacity to drive such apparatus as reel motors, but which would have sufficient capacity to release a self latching magnetic brake. The remaining operation of the unwinding function of the reel is thus rendered free of the supply of any power, gravity causing the cable to unwind to its proper position.

Persons standing on each of the balconies can now descend on the cable. An emergency descent device 8 is slipped over the cable, and its brake is closed. This effectively locks the device to the cable, and the user attaches a seat, sits on it, and releases the brake slowly. He then descends down the rope.

As can be seen in FIG. 1, a plurality of emergency descent devices with users attached are descending at the same time down a single rope. Clearly more than one person from each level can use the same cable, and a plurality of persons from different levels can use the same cable.

Further, if additional persons find their way to one cable from other areas of the building, additional descent devices can be attached easily, merely by slipping them on the cable. This is distinguished from the prior art descent devices described earlier, in which only a predetermined number of such devices could be used on a single cable, those which had been prethreaded on the rope or cable. In the prior art, once the cable has been lowered, no additional descent devices can be added, thus establishing a dangerous condition since there would be no additional devices available for use once the prethreaded devices have been used up.

FIG. 1*a* is a detail of the magnetic brake. The brake is comprised of a pair of steel armatures, which are normally held on a frame 10 attached to the top of the building and are magnetically latched together, closing on the cable 6. If desired, a pair of brake pads 11 operated by the armatures can be used, thus clamping the cable 6 against movement. With the cable entirely wound on the reel except for the weighted end, which hangs over the reel 5 which is cantilevered past the top of the building, it is held in position by the magnetically latched armatures.

As soon as the fire alarm rings, current is passed along wires 12 to the magnetic brake which operates the armatures, thus releasing them, which are caused to latch open. The brake thus releases the cable 6, allowing the weight 7 to draw it down to the ground.

It is preferred that a plurality of such reels and cables should be provided, e.g., in a 230 unit apartment having 11 floors, 21 cables could be utilized around the building.

Turning now to FIG. 2, the details of the preferred embodiment of the descent device is shown. A pair of friction members 15 and 16, preferably each cut from a two inch by four inch nominal cross-section piece of hardwood, about 10 inches long, have cooperatively shaped adjacent convoluted surfaces 17 and 18, for frictionally pressing on the cable. In one successful prototype, a central five inch length convex section protruded from friction member 16, toward a cooperatively shaped concave section in friction member 15, each of the sides of the concave and convex sections cut at about a 45° degree angle.

A first cable guide is located on one side of the friction members, which could be a flat piece of aluminum or steel fastened on one friction member and extending substantially across the side of the other friction member. However, in the preferred embodiment, a pair of bolts 19 and 20 are used, which are located to one side of the friction members along the length thereof. The bolt is preferably fastened in one friction member, e.g. friction member 15, and each passes through a corresponding hole 21 and 22 in friction member 16, in order that friction member 16 should slide along the bolts. Also, preferably the opposite sides of the friction members are faced with steel or aluminum plates 23 and 24, which provides firm bearing surfaces for the ends of the bolts, which could otherwise bite into the wood of the friction members.

A keeper, or nut locked to the end of bolts 19 and 20 retains friction member 16 on the bolts; otherwise the loosened apparatus could come apart.

A screw member, preferably in the form of a bolt 25, with a keeper or locknut 25A, extends through both friction members 15 and 16. Preferably the bolt 25 should have a manually operable end, for turning the bolt. The bolt passes through friction member 16, and is threaded to end plate 23, whereby rotation of the bolt 25 causes friction members 15 and 16 to draw together.

A second cable guide is attached at the other side of friction members 15. In the preferred embodiment, the guide is comprised of a pair of bolts 26 and 27 which pass through friction member 15, only part way across the gap between both friction members. Preferably the bolts extend from the inward portion of the concave section of friction member 15, and approximately to the outward upper portions of friction member 15.

Consequently, when friction members 15 and 16 are at a wide predetermined position apart, with the convex portion of friction member 16 spaced from the ends of bolts 26 and 27, the cable can be passed between the ends of bolts 26 and 27 and the convex surface of friction member 16, against bolts 19 and 20. Friction members 15 and 16 are then drawn together by turning bolt 25, causing bolts 26 and 27 to close to friction member 16. Bolts 26 and 27 then pass into coaxial holes 28 and 29 in friction member 16, thus allowing friction members 15 and 16 to be drawn closer and tighter on cable 6, without interference to bolts 26 and 27. However bolts 26 and 27 have effectively locked the cable within the convoluted regions between the friction members 15 and 16. The control bolt 25 is thus turned until the cable 6 is effectively locked therebetween.

A pair of eye bolts 30 and 31 are fixed adjacent the bottoms of the friction members, and can be bolted to plates 23 and 24, or to the friction members themselves. The eyes of the eye bolts extend outwardly opposite each other. A pair of swivelling snap shackles 32 and 33 are detachably affixed to the eye bolts, and seat cable 34 and 35 are respectively connected to the snap shackles, using, e.g., nicopress sleeves. In a successful prototype, the seat cables were 1/16th inch diameter stainless steel cable.

The cables are connected via "Y" branches under a seat 36. In the aforenoted successful prototype, the seat was fabricated of ¼ inch thickness plywood. In order to take the strain off the plywood seat when a person is seated thereon, it is preferred to cross the branched seat cables underneath.

A pair of belt loops 37 and 38, each having a hole through which a corresponding cable 34 and 35 passes, and an elongated slot for accommodating a belt, is attached to the individual seat cables 34 and 35. The belt loops can be made of aluminum.

In operation, once the friction members have been clamped around the cable 6, the user attaches a belt through the belt loops, and draws the plywood seat against his posterior. The belt which is used can be either his own belt, or a belt which is supplied with the apparatus and is normally looped through the belt slots.

After the plywood seat is drawn against his posterior, the user leans over the balcony or window adjacent which the cable 6 with the friction members clamped thereto is located, and attaches the snap shackles 32 and 33 to eye bolts 30 and 31. The user then places all his weight on the seat, and is held in position by the belt. The user can also steady himself by holding onto seat cables 34 and 35.

The user, now suspended by means of the friction members being clamped on cable 6, unscrews brake control bolt 25 until the friction members begin sliding on cable 6. If the descent is too slow, the brake control bolt 25 is turned in one direction, loosening the friction members, and if the descent is too fast, the brake control bolt can be turned in the opposite direction, thus tightening the friction members.

Of course, rather than having an eye bolt or thumb screw adjustment end to bolt 25, a lever could be used, for ease of adjustment.

It should be noted that the forces on friction members 15 and 16 when a user is seated on seat 36 is to close or tighten the bottom of the pair of friction members, thus effectively causing a slowing of descent.

Also, as users are hung from cable 6 below, the cable tightens, thus causing additional pressure on convoluted surfaces 17 and 18, also effectively aiding the slowing of descent.

It is believed that the use of the present invention will facilitate the saving of a great many lives which otherwise could be lost due to fire in high-rise buildings.

Referring now to FIG. 3, which shows a further embodiment, it should be noted that it is not necessary to utilize two bolts or dowels 26 and 27 as shown in FIG. 2; only one dowel 40 can be used. Should the friction members 15 and 16 tilt about the plane which contains the cable, the cable will be retained between the guide formed by dowel 40 and the upper or lower opposite guides 19 and 20.

Further, the guide shown in FIG. 2 formed by a bolt 19 can be threaded into one of the friction members e.g., as shown at reference 41 in FIG. 3, the bolt passing unthreaded or threaded with opposite bias through friction member 16. The portion of the bolt extending outside friction member 16 opposite to the threaded portion can be fixed to a crank 42, and held thereto for example by a cotter pin 43. A square hole in the crank and a square head on the bolt 19 fitted into the hole of the crank, held together by the cotter pin, will suffice. A stopper nut, or large outside diameter washer 44 held under the head of the bolt or by a spacer from the crank bears against the friction member 16, allowing friction member 15 to be drawn toward friction member 16 as the crank is turned. In this embodiment bolt 25 (FIG. 2) can be dispensed with.

It has also been found that cooperating convoluted adjacent surfaces of the friction members are not necessary, in the embodiment shown in FIG. 3. The adjacent surfaces of the friction members are plane in form, thus reducing their cost considerably.

In operation, the crank is turned so as to widen the space between the friction members, causing the end of dowel (or bolt) 40 to become outwardly spaced from the adjacent surface of friction member 16. The apparatus is then applied to the cable so that the cable bears against bolts 19 and 20. The crank is then turned to narrow the space between the friction members, and the dowel 40 becomes inserted into a cooperating hole 45 in friction member 16 in a similar manner to the embodiment of FIG. 2, thus retaining the cable between the guides formed by elements, 40, 19 and 20 within the apparatus.

The crank is further turned until both friction members make friction contact with the cable. The seat or other suspension apparatus is attached to eye bolts 30 and 31, and when weight is applied thereto, pressure is as a result applied to the lower portions of the friction members, forcing them together. This causes increased energy to be absorbed as the apparatus slides down the cable. The speed of descent can be controlled by adjusting the force between the friction members by turning crank 42 in either clockwise or counterclockwise direction.

The friction members can be faced with leather brake pads, or the brake pads can be eliminated and aluminum blocks can be used as friction members 15 and 16.

A person understanding the principles of the present invention may now conceive of changes or other embodiments, using the principles of the present invention. All are considered to be within the sphere and scope of the invention as defined in the claims appended hereto.

I claim:

1. An emergency descent device comprised of a pair of friction members having cooperatively shaped adjacent convoluted surfaces, means for adjusting the space between the surfaces, first cable guide means extending from one member to the other on one side thereof for retaining a cable between the convolutions of said surface, and second cable guide means fixed to one member and and extending from said one member to the other on the other side thereof when the surfaces are a first predetermined distance apart in which the convolutions are substantially enfolded, and extending from said one member toward, but not as far as the other when the convolutions are a second predetermined distance apart in which the convolutions are not substantially enfolded, whereby said cable can be slipped between said surfaces and between the first and second cable guide means when the surfaces are said second distance apart, and be retained therebetween when the surfaces are adjusted to said first distance apart, said first cable guide means being in the form of a pair of dowel shaped members fixed adjacent mutually opposite ends on said one side of one friction member and directed toward the other friction member, and slideably passing through holes in the other friction member, whereby the lateral positions of the friction members are fixed relative to each other as the friction members are adjusted in distance therebetween, and further including means attached to the friction members for suspending a body.

2. An emergency descent device as defined in claim 1, in which the dowel shaped members are formed of bolts, each passing completely through said other friction member when said friction members are said second distance apart, and having friction member retaining means fixed to the ends of said bolts.

3. An emergency descent device as defined in claim 2, in which said retaining means are formed of nuts locked to said bolts, each having a diameter greater than the diameter of an associated one of said holes.

4. An emergency descent device as defined in claim 1, 2 or 3, in which the second cable guide means are in the form of a second pair of dowel shaped members fixed adjacent the other side of one of the friction members and pointed toward the other, and located in at least one concave section of its convoluted surface, said other friction member having coaxially located holes for slideably accommodating said second pair of dowel shaped members.

5. An emergency descent device as defined in claim 1, in which the means for adjusting is comprised of screw means threaded between the pair of friction members for adjusting the spacing between the friction members and thereby frictionally clamping a cable extending therebetween, when the screw means is turned.

6. An emergency descent device as defined in claim 5, in which the friction members are comprised of blocks of hardwood.

7. An emergency descent device as defined in claim 1, 5 or 6, further including means for shackling a seat cable to one end of each of the friction members.

8. An emergency descent device as defined in claim 1, 5 or 6, further including a seat retaining cable having its ends shackled to one end of each of the friction members, cable adjacent each end forming the leg of a Y, a seat for accommodating a user, the arms of each Y passing through holes adjacent opposite corners of the seat and extending continuous under the seat.

9. An emergency descent device as defined in claim 5 or 6, further including a seat retaining cable having its ends shackled to one end of each of the friction members, the cable adjacent each end forming the leg of a Y, a seat for accomodating a user, the arms of each Y passing through holes adjacent opposite corners of the seat and extending continuous and crossing diagonally under the seat.

10. An emergency descent device as defined in claim 1 in which the dowel shaped members are formed of bolts, each passing completely through said other friction member when said friction members are said second distance apart, and having nuts locked to the end of said bolts, each having a diameter greater than the diameter of an associated one of said holes; the second cable guide means are a second spaced pair of dowel shaped members fixed adjacent the other side of one of the friction members and pointed toward the other, and located in a concave section of its convoluted surface, said other friction member having coaxially located holes for slideably accommodating said second pair of dowel shaped members, the means for adjusting is comprised of screw means threaded between the pair of friction members for adjusting the spacing of the friction members and thereby frictionally clamping a cable extending therebetween when the screw means is turned, the friction members being comprised of blocks of hardwood having opposite disposed external stiff metal facing panels fixed to their surfaces through which said bolts extend, and a seat retaining cable having its ends shackled to one end of each of the friction members, the cable adjacent each end forming the leg of a Y, a seat for accommodating a user, the arms of each Y passing through holes adjacent opposite corners of the seat and extending continuous and crossing diagonally under the seat.

11. An emergency descent device as defined in claim 10, further including means retained by the seat retaining cable adjacent each end for accommodating a belt for passing around a user.

12. An emergency descent device as defined in claim 6 or 10, further including an emergency descent cable for passing between the convoluted surfaces and being retained between the first and second cable guide means, a descent cable reel fixed to the roof and adjacent the edge of a building, and a descent cable brake means adapted to be released in the event of a fire alarm, whereby the descent cable can be unreeled from the cable reel toward the ground, and one or a plurality of the friction members can frictionally slide down the cable with a user suspended therefrom.

13. An emergency descent device comprised of a pair of friction members having cooperatively shaped adjacent convoluted surfaces, means for adjusting the space between the surfaces, first cable guide means fixed to one member and extending from said one member to the other on one side thereof for retaining a cable between the convolutions of said surface, and second cable guide means fixed to and extending from one member to the other on the other side thereof when the surfaces are a first predetermined distance apart in which the convolutions are substantially enfolded, and extending from said one member toward, but not as far as the other when the convolutions are a second predetermined distance apart in which the convolutions are not substantially enfolded, whereby said cable can be slipped between said surfaces and between the first and second cable guide means when the surfaces are said second distance apart, and be retained therebetween when the surfaces are adjusted to said first distance apart, further including an emergency descent cable for passing between the convoluted surfaces and being retained between the first and second cable guide means, a descent cable reel fixed to the roof and adjacent the edge of a buiding, and a descent cable brake means adapted to be released in the event of a fire alarm, whereby the descent cable can be unreeled from the cable reel toward the ground, and one or a plurality of the friction members can frictionally slide down the cable with a user suspended therefrom.

14. An emergency descent device comprised of a pair of friction members having cooperatively shaped adjacent surfaces, means for adjusting the space between the tops of the friction members, first cable guide means fixed to one member and extending from one side to the other on one side thereof for retaining a cable between said surfaces, second cable guide means fixed to one member and extending from said one member to the other on the other side thereof when the surfaces are a first predetermined distance apart, and extending from said one member toward, but not as far as the other when the surfaces are a second predetermined farther distance apart, whereby the cable can be slipped between the surfaces and between the first and second cable guide means when the surfaces are said second distance apart, and be retained therebetween when the surfaces are adjusted to said first distance apart, and further including a pair of attachment rings each fixed to one of the friction members and extending outwardly in opposite directions, whereby upon applying downward force on the friction members as by supporting a body, the rings are thereby caused to apply a resultant force toward each other through the friction members, drawing the bottoms of the friction members together.

15. An emergency descent device as defined in claim 14 in which the means for adjusting the space between the tops of the friction members is comprised of a crank or lever, having an axis of rotation passing through both friction members, and being threaded on at least one thereof.

16. An emergency descent device as defined in claim 14, in which said first cable guide means are in the form of a pair of dowel shaped members fixed adjacent mutually opposite ends on said one side of one friction member and directed toward the other friction member, the other friction member containing holes whereby the dowel shaped members can slide therein, whereby the lateral positions of the friction members are fixed relative to each other as the friction members are adjusted in distance therebetween.

17. An emergency descent device as defined in claim 16, in which an upper one of the dowel shaped members is in the form of a bolt having one end threaded into one of the friction members, and having its other end passing through a hole in the other friction member, the other friction member being retained thereon by means of a nut or washer secured to the bolt adjacent its end opposite the threaded end, said latter end of the bolt being in the form of, or being attached to, a crank.

18. An emergency descent device as defined in claim 14, 15 or 16 in which the adjacent surfaces of the friction members are plane.

* * * * *